United States Patent [19]

Grim

[11] Patent Number: 4,999,932

[45] Date of Patent: Mar. 19, 1991

[54] VARIABLE SUPPORT SHOE

[75] Inventor: Tracy E. Grim, Broken Arrow, Okla.

[73] Assignee: Royce Medical Company, Westlake Village, Calif.

[21] Appl. No.: 310,836

[22] Filed: Feb. 14, 1989

[51] Int. Cl.[5] ..... A43B 7/06; A43B 7/14

[52] U.S. Cl. ..... 36/88; 36/114; 36/29; 36/3 B; 36/71

[58] Field of Search ..... 36/3 R, 3 A, 3 B, 29, 36/71, 88, 89, 93, 119, 114, 86; 128/594

[56] References Cited

U.S. PATENT DOCUMENTS

| | | | |
|---|---|---|---|
| 2,552,711 | 5/1951 | Dunker . | |
| 2,560,591 | 7/1951 | Oltrogge . | |
| 2,676,422 | 4/1954 | Crawford . | |
| 3,029,530 | 4/1962 | Eaton . | |
| 3,331,146 | 7/1967 | Karras . | |
| 3,716,930 | 2/1973 | Brahm | 36/3 B |
| 4,178,013 | 12/1979 | Bataille | 36/119 X |
| 4,232,459 | 11/1980 | Vaccari | 36/71 |
| 4,236,725 | 12/1980 | Bataille | 36/93 X |
| 4,280,489 | 7/1981 | Johnson, Jr. . | |
| 4,361,969 | 12/1982 | Vermonet | 36/29 X |
| 4,414,760 | 11/1983 | Faiella . | |
| 4,631,843 | 12/1986 | Annovi | 36/71 X |
| 4,730,403 | 3/1988 | Walkhoff | 36/119 |
| 4,763,426 | 8/1988 | Polus et al. | 36/29 |
| 4,823,482 | 4/1989 | Lakic | 36/119 X |

FOREIGN PATENT DOCUMENTS

| | | | |
|---|---|---|---|
| 152401 | 8/1985 | European Pat. Off. | 36/93 |
| 1685781 | 7/1970 | Fed. Rep. of Germany | 36/71 |
| 2321817 | 11/1973 | Fed. Rep. of Germany | 36/3 R |
| 2356384 | 1/1978 | France | 36/71 |
| 2424716 | 11/1979 | France | 36/3 R |
| 2614510 | 11/1988 | France | 36/3 B |
| 53447 | 5/1967 | Poland | 36/3 R |
| 866934 | 5/1961 | United Kingdom | 128/594 |

*Primary Examiner*—Steven N. Meyers

*Attorney, Agent, or Firm*—Poms, Smith, Lande & Rose

[57] ABSTRACT

An athletic shoe includes a substantially flat pump chamber in the sole of the shoe under the heel of the user, with a one-way valve permitting the drawing in of air when pressure is taken off the heel, and second one-way valve at the outlet from the flat pump which comes into play as air is being exhausted from the chamber. One or more pressure bladders for receiving air from the pump mentioned above, are mounted in the sidewalls of the shoe, toward the rear thereof adjacent the ankle. When the user is active, and is walking or running, the pump is actuated to inflate the air bladders and to provide additional support for the foot and the ankle. The air bladders may be provided with a relief valve to prevent overpressure, and with arrangements for slowly leading air out of the bladder so that when the user is resting, pressure on the foot and ankle is minimized. This last function may be accomplished, either by a bleed valve, or by a series of fine perforations in the walls of the bladder.

9 Claims, 4 Drawing Sheets

VARIABLE SUPPORT SHOE

FIELD OF THE INVENTION

This invention relates to athletic shoes, providing additional support for the user.

BACKGROUND OF THE INVENTION

It has previously been proposed to provide an ankle brace, or orthopedic apparatus including air inflatable bladders as shown in U.S. Pat. No. 4,280,489, in which the apparatus is intended to be worn within a separate shoe, and is inflatable with an external source of air pressure In addition, various arrangements have been proposed for ventilating shoes by circulating air through the shoes. Typical patents showing this type of arrangement include M. Dunker U.S. Pat. No. 2,552,711; D. W. Oltrogge, U.S. Pat. No. 2,560,591; A. C. Crawford, U.S. Pat. No. 2,676,422; C. N. Eaton U.S. Pat. No. 3,029,530; E. Karras, U.S. Pat. No. 3,331,146; and James Faiella, U.S. Pat. No. 4,414,760. These patents disclose the use of air pumping arrangement actuated by foot pressure for circulating air through a shoe, but do not include any orthopedic support functions.

In connection with athletic activities, such as football, basketball, tennis, or other vigorous activities, it is helpful if the footwear worn by the players gives full support to the foot and ankle to avoid sprains or subluxation, when vigorous movement is undertaken by the athlete. However, when the athletes are resting, on the bench, for example, it is undesirable to have the feet or ankles subject to substantial pressure, as this may inhibit circulation or the like during these rest periods.

Accordingly, a principal object of the present invention is to provide an athletic shoe which gives variable support to the foot and ankle, with increased support during periods when the user is active, and reduced or minimal support when the user is at rest. Another object of the invention is to provide an orthopedic shoe in which external air pumping arrangements are not required.

SUMMARY OF THE INVENTION

In accordance with the present invention, an athletic shoe is provided with an air pump included in the sole, preferably under the heel of the shoe, and air support bladders are mounted in the sides of the shoe and adjacent the upper rear portion of the shoe in the vicinity of the ankle, with the air bladders being connected to receive air pressure provided by the pump in the sole of the shoe.

These air bladders may have a high pressure release valving arrangement, and also be provided with bleed arrangements, so that the bladders may not be inflated above a predetermined pressure, and so that the air pressure in the bladders will gradually leak out over a period of time.

One-way valves may be provided, both at the inlet to the pump, and at the outlet therefrom, leading to the air bladders. In this way, pressure will be drawn in whenever the foot is raised, and air will be pumped out to the air bladders whenever the foot engages the ground, and the pump chamber is compressed. The bladders may have a bleed valve arrangement as mentioned above which may be either in the form of a specific physical valve, or this function may be provided through a series of small holes extending through the surface of the support bladders mounted in the sidewalls of the shoes.

The pump may be in the form of a relatively flat chamber underlying the heel of the user, and being normally resiliently biased so that the air chamber is expanded. Then, when the weight of the person's heel is applied downward onto the chamber, it is compressed, and the air is forced into the support bladders. Subsequently, when the foot is raised, the pump chamber expands, under the resilient force, and air is sucked into the pump chamber. This process is repeated until the support bladders reach their full rated pressure. At this pressure level, the release valve may prevent further build-up of pressure within the bladders, thus controlling the level of pressure against the foot and ankle and the resultant support.

The valves may be implemented by separate valves which may be purchased independently and installed in the interconnecting tubing, or they may be implemented by integral plastic parts in the form of flaps or resiliently mounted plugs which close and open to control the air flow in a manner similar to the separate or independent valves.

At the outlet from the pump, a single one-way valve may be provided, or, alternatively, separate one-way valves may extend to each of the support bladders.

The advantage of the system of the present invention is that full support to the foot is provided when the user is active, but, when the user is resting, or the athlete is on the bench, the bleed arrangements permit the full reduction of pressure in the bladders, so that heavy support pressure is not applied to the foot during rest periods, and full circulation and recuperation of the foot may occur.

Other objects, features, and advantages of the invention will become apparent from a consideration of the following detailed description and from the accompanying drawings.

DETAILED DESCRIPTION

Figure 1:
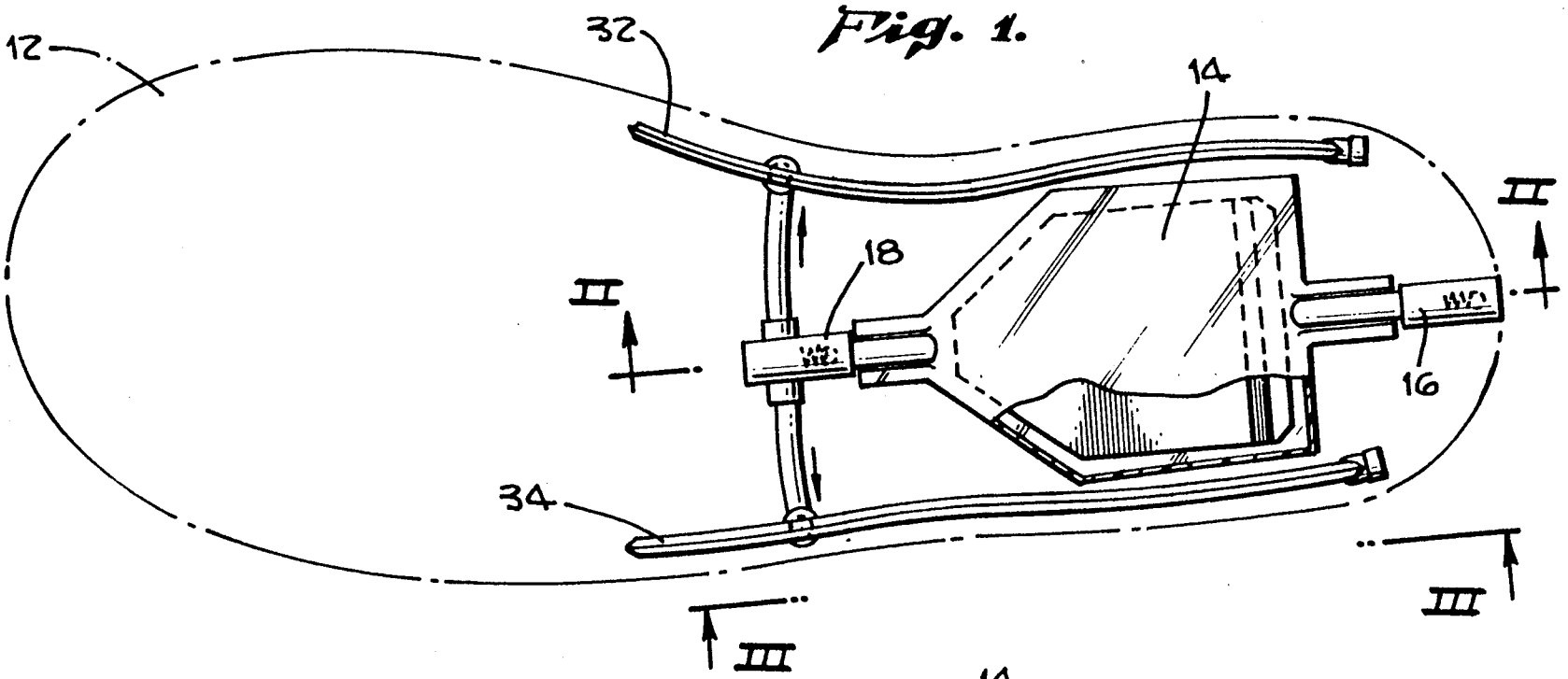
FIG. 1 is a top view of the sole portion of a shoe provided with pumping and support bladders, illustrating the principles of the present invention.
Figure 2:
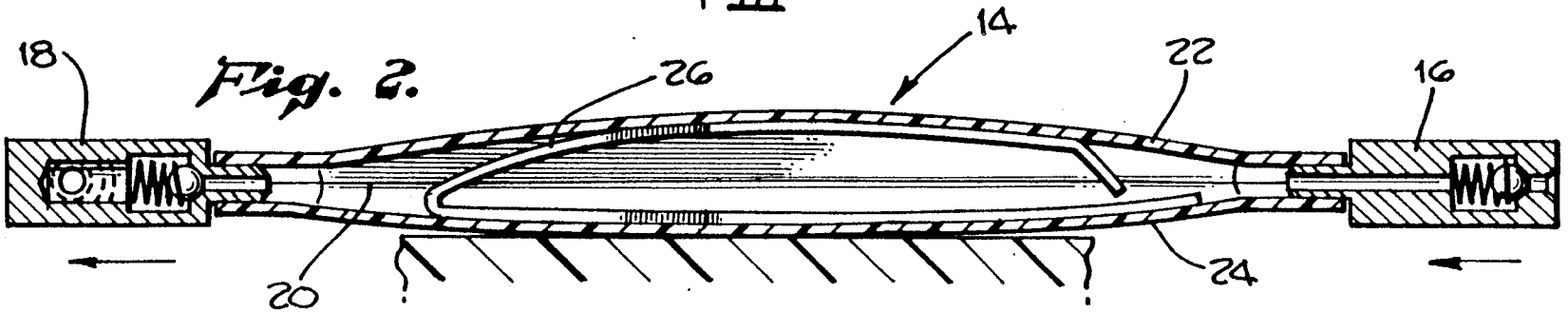
FIG. 2 is a side view of the pump structure taken along plane II—II of FIG. 1.

Referring more particularly to the drawings, FIG. 1 is a top view of the sole portion of a shoe 12 as shown in diagrammatic or outline form. Toward the rear of the shoe, under the heel area, is a pump 14 having an inlet valve 16, and an outlet valve 18. As better shown in the cross-sectional view of FIG. 2 of the drawings, the pump 14 includes a chamber 20 having upper and lower flexible sidewalls 22 and 24, and a resilient bent metal spring member 26 which may be formed of brass, or a suitable, flexible spring steel, and which normally biases the chamber 20 to its expanded volume configuration. When the user steps down on the pump 14, the valve 18 opens, and the valve 16 is closed. However, when the foot is raised and pressure is released from the pump 14, the resilient spring member 26 expands the chamber 20, drawing air in through the valve 16, while the valve 18 is closed.

Figure 3:
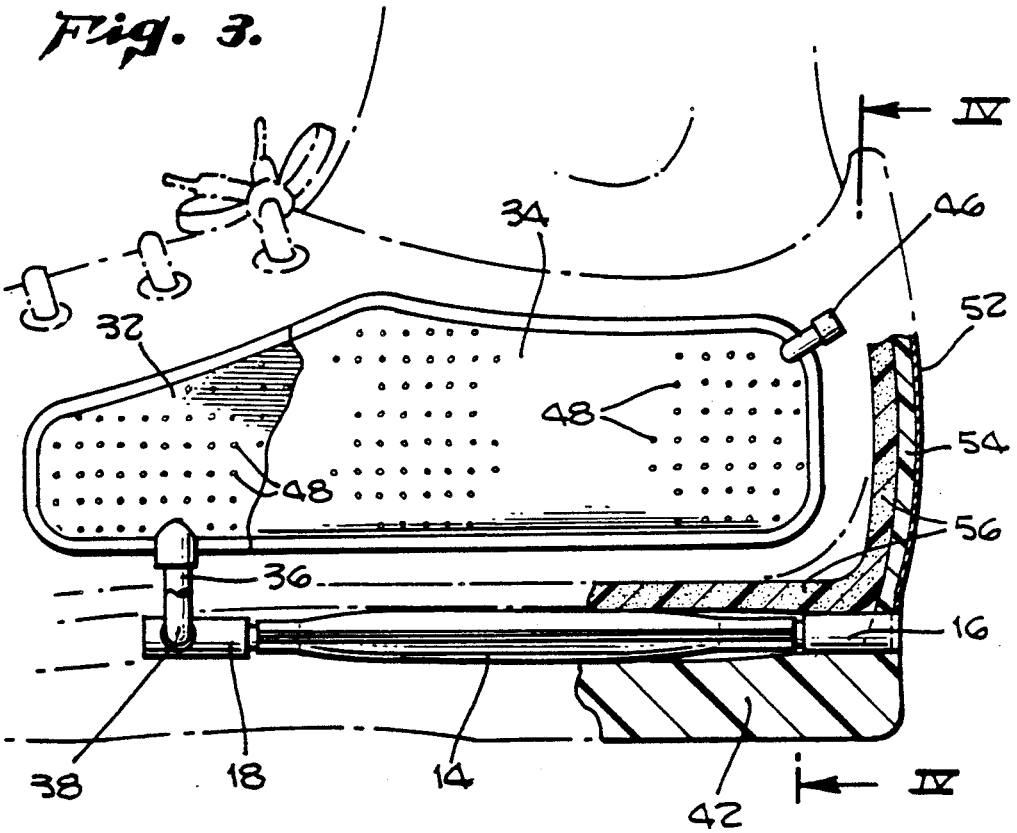
FIG. 3 is a side view of an athletic shoe provided with a pump in the heel portion of the sole of the shoe, and support bladders mounted on the inner sides of the shoe.

Shown to advantage in FIG. 3, as well as in FIG. 1, two support bladders or chambers 32 and 34 may be provided, and these may extend along the sides of the foot, and over the upper surface of the outer portion of the foot, and along the side and the rear portion of the instep of the user. Extending upward from the valve 18 are two small diameter tubes 36 and 38 connected to the bladders 32 and 34, respectively.

Figure 4:
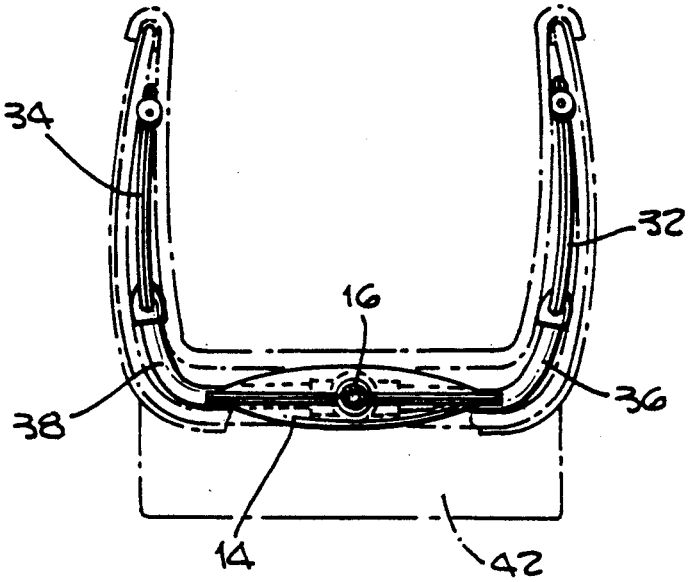
FIG. 4 is a cross-sectional view taken along plane IV—IV of FIG. 3.

Incidentally, FIG. 4 is a cross-sectional view taken along the plane IV—IV of FIG. 3 and showing the sole 42, the pump assembly 14, the inlet valve 16, the two side chambers 32 and 34, and the coupling tubes 36 and 38. The shoe is shown in dash-dot lines, while the pump and the support bladders are shown in solid lines.

Figure 5:
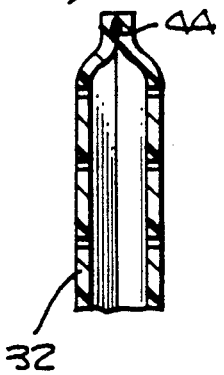
FIG. 5 is a partial cross-sectional view taken along plane V—V of FIG. 3.

FIG. 5 shows one of the bladders 32 formed of two portions of sheet plastic, heat-sealed together at point 44.

Returning to FIG. 3, the valve 46 is an overpressure release and a bleed valve. More specifically, a slight amount of air is permitted to bleed from the valve 46 continuously over prolonged periods of time, as will be discussed hereinbelow, and the valve 46 changes state to releases air from the bladder when pressure supplied by the pump 14 becomes excessive, so that a maximum pressure level is maintained within the bladders 32 and 34 during active use of the footwear. The relief valve 46 may provide a maximum pressure of between 0.5 psi and about 5 psi, above atmospheric pressure, and may either be adjustable, or preset to the desired relief pressure. As an alternative to the bleed function which may be included in the valve 46, the bladders 32 and 34 may be provided with a number of very small holes 48, which may be in the nature of pin holes, which may provide the bleed function which may otherwise be accomplished through the valve member 46.

Incidentally, the relief valves 46 may be located at any desired position, including adjacent to the entry duct 86, or along the lines from the pump to the bladders.

The shoe may have an outer wall 52 which may be formed of leather or heavy fabric material, a structural lining 54 immediately within the outer wall 52, and an inner resilient liner 56 within the structural walls 52 and 54, and overlying the pump member 14 on the sole of the shoe. The bladders 32 and 34, and the ducts 36 and 38 may be embedded or recessed into the wall 56.

Figure 6:
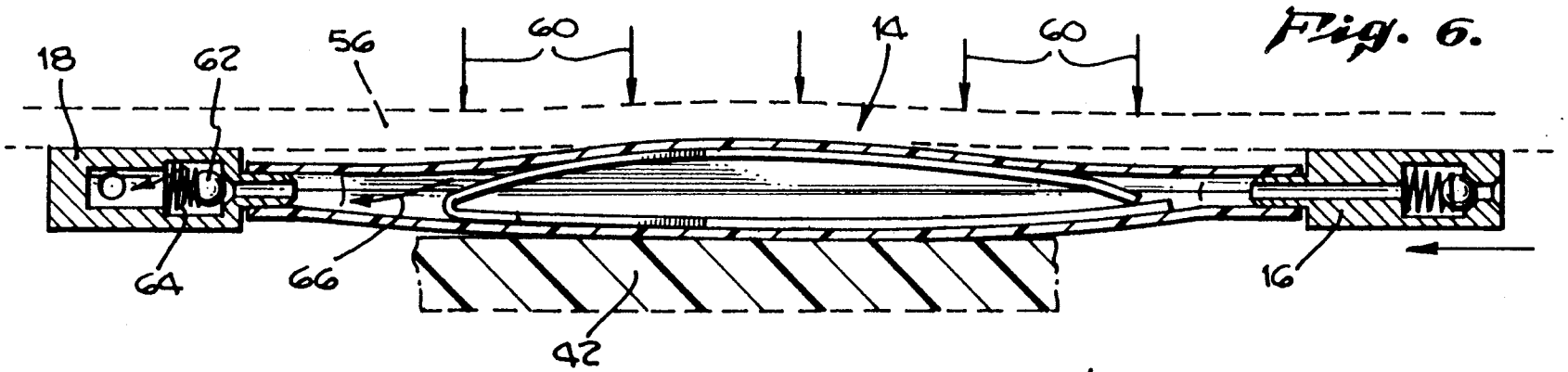
FIG. 6 is a cross-sectional view similar to that of FIG. 2 showing force applied to the pump, and the output one-way valve being released.

Now, referring to FIG. 6, the mode of operation of the pump 14 under operating conditions is illustrated. More specifically, the arrows 60 indicate the force of the foot or heel acting downward to compress the flat chamber configuration of the pump 14. Air has previously been drawn into the pump chamber 20 through the inlet valve 16. Now, when downward pressure indicated by arrows 60 compresses the chamber 20 of pump 14, the one-way valve 18 opens, and air flows through the valve 18 to the two support bladders or chambers 32 and 34. The valve 18 is indicated as including a ball 62, spring-biased by the spring 64 toward its seat, but shown in FIG. 6 in the open configuration, as the chamber 20 is being compressed, and air is flowing toward the valve 18 as indicated by the arrow 66.

Figure 7:
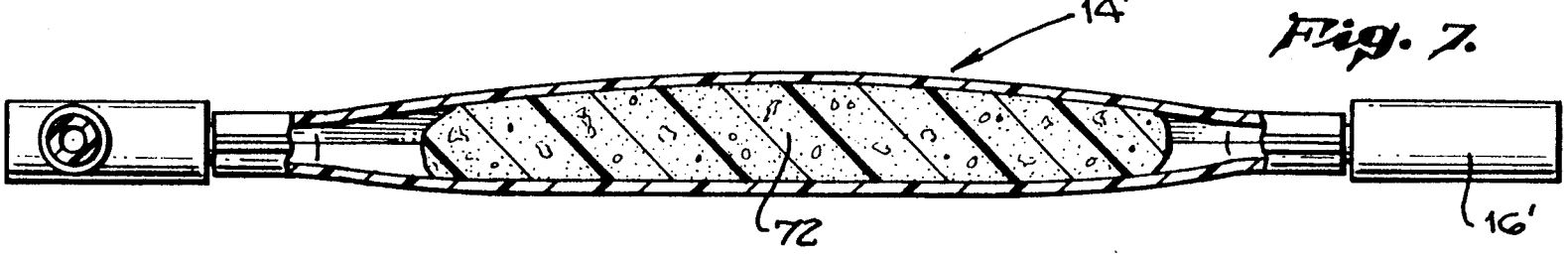
FIG. 7 shows an alternative embodiment of the pump arrangement of FIG. 6.

FIG. 7 shows an alternative embodiment of the pump 14' in which the spring 26, as shown in FIG. 6, has been replaced by the resilient material 72, which may be a relatively stiff, open cell foam material, which serves substantially the same function as the spring 26. The open cell foam material 72 may have channels extending through it to facilitate air flow from the valve 16' to the valve 18'. Otherwise, the pump of FIG. 7 operates in the same manner as that of FIG. 6 as discussed above.

Figure 8:
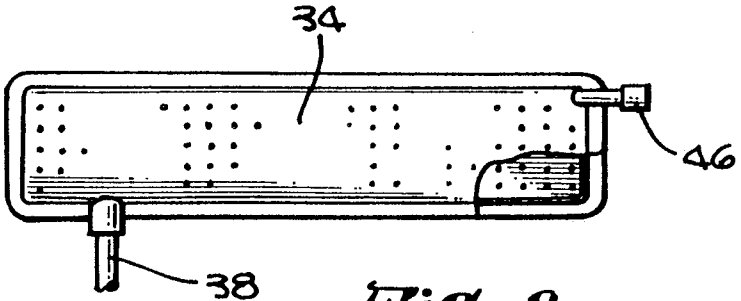
FIG. 8 is a side view of a support bladder which may be employed on the inner sides of the shoe of FIG. 3.

FIG. 8 is a detailed showing of one of the support bladders 34, which has been described in some detail hereinabove in connection with earlier figures of the drawings.

Figure 9:
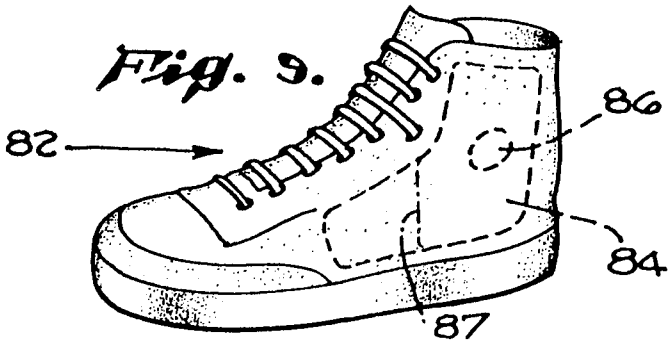
FIG. 9 indicates schematically the principles of the invention as applied to a high top shoe.

FIG. 9 shows an embodiment of the invention as applied to high top shoes of the type which might be employed for basketball, by way of specific example. More particularly, the shoe 82 may be provided with two support bladders, one of which is shown at 84, diagrammatically indicated on the outer side of the shoe. The bladder may have one central area 86 where the opposite walls of the bladder are secured together, so that no inflation occurs. This area 86 is located at the zone where the ankle bone protrudes outwardly from the foot. Alternatively, the bladder may be continuous, without the areas 86, so that the air bladder covers the entire ankle area. The two bladders, one on the inside and one on the outside of the foot may be inflated as described hereinabove for the low quarter shoe of FIG. 3. Also, the forward extent of the bladders could be limited to the line 87 as shown in FIG. 9 when pressure on the forward area of the foot is not desired.

Figure 10:
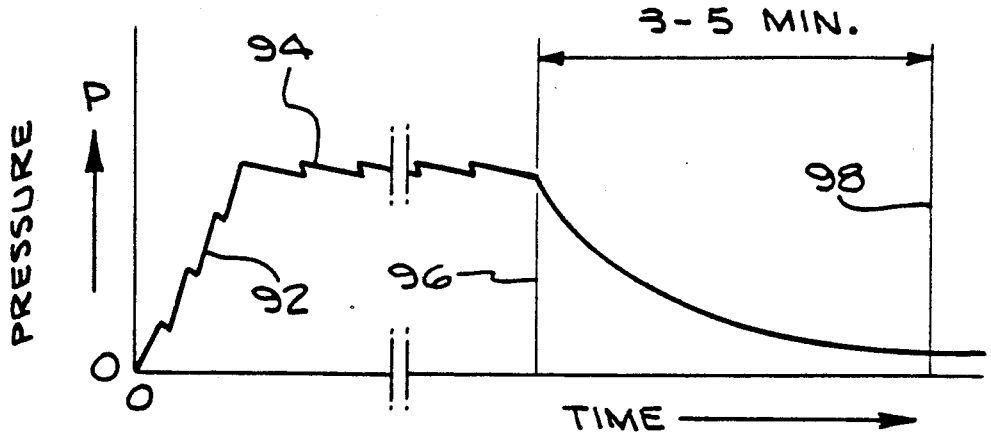
FIG. 10 is a qualitative showing of the pressure within the support chambers during active use by an athlete, and during rest periods.

FIG. 10 is a schematic diagram in which pressure in one of the individual bladders 34 and 36 is plotted against time. Initially, of course, at time equal to zero, the support bladders are not inflated. The steep and initial step portion 92 of the plot indicates the increase in pressure within the bladder in increments, on the occasion of successive steps by the user, and accompanying compression of the pump 14. After several steps, the maximum pressure area 94 is reached, and the relief valve 46 comes into play. Finally, as indicated by the line 96, the user is resting, and not actuating he pump 14. Accordingly, the portion 98 of the pressure characteristic indicates the action of the bleed valve, or the fine pin holes in the support bladders 32 and 34. After about 3 to 5 minutes, the pressure is reduced to a relatively low level, so that full circulation may be present in the foot, with the significant additional pressure from the support bladders having been released.

Figure 11:
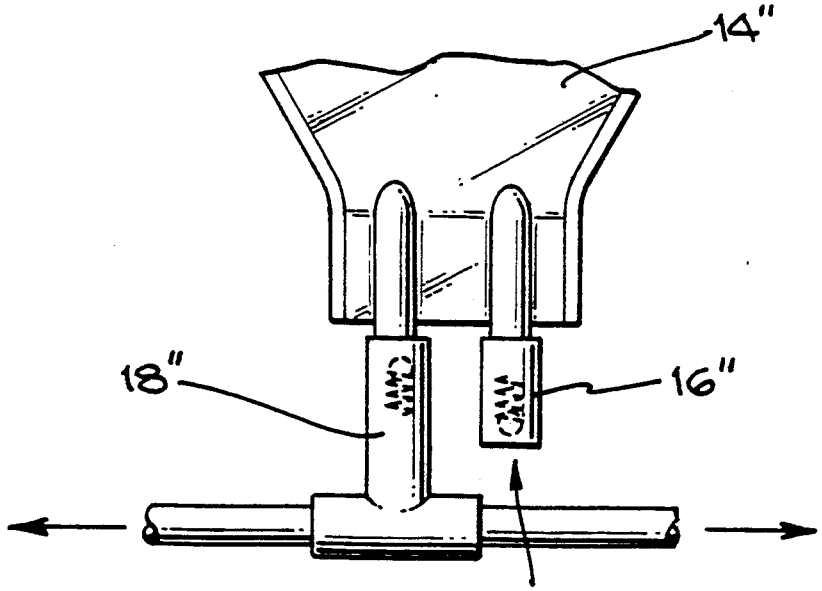
FIG. 11 shows an alternative inlet and outlet configuration for the pump.

FIG. 11 shows another alternative arrangement for the pump 14" in which the inlet 16" is taken from within the shoe, and the outlet 18" is the same as previously shown. Thus, while under certain circumstances and for certain applications, the intake 16 as shown in FIG. 3 would be acceptable under adverse conditions where wet or muddy conditions might prevail, it would be undesirable to draw in moisture, mud, or other foreign material, and accordingly, it would be preferred to draw air in from within the shoe, providing a supplemental ventilating feature by this arrangement.

It is interesting to note that, as the pressure builds up in the support bladders 32 and 34, the valve 18, as shown in FIG. 6, will have additional back pressure on it, and will only open after the pressure level in the pump 14 reaches an elevated level. This will change the resistance encountered by the foot or the heel as the user walks or runs, and there will be less "give" or flexing of the chamber 20, supplementing the increased support provided by the inflated air bladders. It is further noted that, in accordance with the desires of the user, or the orthopedic condition of the user, the pump chamber 20 may be maintained in its more resilient or compressible state by opening the inlet valve 16 when the pressure level in the support bladders exceeds a predetermined level. When this configuration is employed, the resilience or flexibility provided by the pump 14 will be increased, and the stiffness decreased. It is further noted that the arrangements as described hereinabove, and particularly the mode of operation as described in connection with FIG. 10 of the drawings is significantly different from the arrangements of the prior art patents as set forth in the Background of the Invention section of the specification.

In conclusion, it is to be understood that the foregoing detailed description relates to one presently preferred embodiment of the invention. Various changes and modifications may be made without departing from the spirit and scope of the invention. Thus, by way of example, and not of limitation, the various valve structures which have been shown as separate elements, may be implemented by constructions formed from the materials out of which the shoe and/or the bladders are made. Thus, plastic flaps may form one-way valve constructions and the pressure release valve may be formed of a plastic, rubber, or other material which is resiliently biased closed, and forced open when a predetermined level of pressure is reached. Further, foam or some other compressible material may be included within the bladders to maintain shape in the deflated state, or between the bladder and the foot. It is also to be understood that the configuration of the support bladders may be varied to suit the particular athletic activity or the requirements of the user. It is further noted that a pump or bellows may be located under the arch or forefoot instead of, or in addition to that located under the heel, as shown in the drawings. In addition, one or two elongated strips of sheet plastic material may be employed with the high top shoe embodiment, outside of the bladders, between the bladder and the shoe material, on one or both sides of the ankle, to provide additional support and to keep the bladders from stretching the shoe material. Accordingly, the present invention is not limited to the constructions precisely as shown in the drawings or described in the detailed description.

What is claimed is:

1. In a variable air support shoe having a sole, sidewalls secured to said sole, and laces for securing the sidewalls of said shoe together;

the improvement comprising:

inflatable bladders mounted on said sidewalls for applying supporting pressure to the foot and ankle area toward the sides and the rear thereof;

pump means mounted in the sole of the shoe and actuated by walking or running activity for supplying air to said bladders;

relief means for releasing air from said bladders over a predetermined period of time which is relatively long compared to the periodicity of normal walking or running steps; and said bladders having a non-inflatable central zone at the area in the shoe where the user's ankle bone normally extends laterally;

whereby walking or running activity increases the air pressure in said shoe and provides additional support against possible injury to the foot or ankle, and the increased pressure is released within a few minutes after the activity stops to minimize pressure on the foot while resting.

2. A shoe as defined in claim 1 wherein said pump means includes a one-way valve means interconnecting said pump and said bladders.

3. A shoe as defined in claim 1 wherein said shoe includes one-way inlet valve means for air supplied to said pump means.

4. A shoe as defined in claim 3 wherein means are provided for supplying air to said inlet valve means from within the shoe.

5. A shoe as defined in claim 1 wherein said pump means includes a variable volume air chamber and resilient means for biasing said chamber to its expanded configuration.

6. A shoe as defined in claim 1 wherein said pump means is relatively flat and is mounted in the heel area of the shoe.

7. A shoe as defined in claim 1 wherein said shoe extends up over the ankle of the user, and wherein said bladders extend around the ankle area of the shoe.

8. A shoe as defined in claim 1 wherein said relief means includes a plurality of tiny holes in said bladders.

9. A variable air support shoe as defined in claim 1 wherein said relief means limits the maximum pressure in said inflatable bladders.

* * * * *